US011982058B2

(12) United States Patent
Zehbe

(10) Patent No.: US 11,982,058 B2
(45) Date of Patent: May 14, 2024

(54) SELF-PROPELLED GROUND MILLING MACHINE AND METHOD FOR OPERATING A GROUND MILLING MACHINE IN AN EMERGENCY MODE OF OPERATION

(71) Applicant: BOMAG GmbH, Boppard (DE)

(72) Inventor: Jens-Martin Zehbe, Boppard (DE)

(73) Assignee: BOMAG GmbH, Boppard (DE)

( * ) Notice: Subject to any disclaimer, the term of this patent is extended or adjusted under 35 U.S.C. 154(b) by 133 days.

(21) Appl. No.: 17/714,462

(22) Filed: Apr. 6, 2022

(65) Prior Publication Data

US 2022/0316157 A1 Oct. 6, 2022

(30) Foreign Application Priority Data

Apr. 6, 2021 (DE) ..... 10 2021 001 759.5
Jul. 20, 2021 (DE) ..... 10 2021 118 784.2

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127; E02F 3/84; E02F 3/844; E02F 9/2246; E02F 9/226; E02F 9/2289; E02F 9/2292; F15B 20/002; F15B 20/004
See application file for complete search history.

(56) References Cited

U.S. PATENT DOCUMENTS 3,952,510 A * 4/1976 Peterson ..... E02F 9/2221 60/486
4,325,580 A * 4/1982 Swisher, Jr. ..... E01C 23/088 404/90
4,453,451 A * 6/1984 Streeter ..... E02F 9/2239 91/28
2016/0177522 A1 6/2016 Nacke et al.
2017/0130406 A1 5/2017 Steeg et al.
2019/0218750 A1* 7/2019 Saitoh ..... E02F 3/3663
2021/0107559 A1* 4/2021 Frank ..... B62D 5/093

FOREIGN PATENT DOCUMENTS

DE 102012022732 A1 * 5/2014 ..... B62D 5/30
DE 102012022732 A1 5/2014
DE 102014019168 A1 6/2016
DE 102015016678 A1 5/2017

OTHER PUBLICATIONS

English Language Translation of Gerhardy, DE-102012022732-A1, published May 22, 2014 (9 pages) (Year: 2014).*
German Patent Office, Search Report, Application No. 102021118784.2, dated Mar. 1, 2022 (4 pages).

* cited by examiner

*Primary Examiner* — Janine M Kreck
*Assistant Examiner* — Michael A Goodwin
(74) *Attorney, Agent, or Firm* — Wood Herron & Evans LLP

(57) ABSTRACT

The present invention relates to a self-propelled ground milling machine and a method for operating a ground milling machine in an emergency mode of operation.

8 Claims, 3 Drawing Sheets

SELF-PROPELLED GROUND MILLING MACHINE AND METHOD FOR OPERATING A GROUND MILLING MACHINE IN AN EMERGENCY MODE OF OPERATION

CROSS-REFERENCE TO RELATED APPLICATIONS

The present application claims priority under 35 U.S.C. § 119 of German Patent Application No. 10 2021 001 759.5, filed Apr. 6, 2021 and German Patent Application No. 10 2021 118 784.2, filed Jul. 20, 2021, the disclosures of which are hereby incorporated herein by reference in their entireties.

FIELD OF THE INVENTION

The present invention relates to a ground milling machine and a method for operating a ground milling machine in an emergency mode of operation.

BACKGROUND OF THE INVENTION

A generic ground milling machine is self-propelled and comprises a machine frame, an operator platform, a primary drive unit with which the drive energy required for regular operation of the ground milling machine is provided, a ground milling device with a milling drum arranged within a milling drum box and rotatable about a rotation axis, and front and rear travel units, wherein at least one of the front and/or the rear travel units is connected to the machine frame via a lifting device adjustable in vertical direction. Such ground milling machines are known, for example, from DE102015016678A1 and DE102014019168A1. Such ground milling machines are normally used in road and pathway construction and for roadway resurfacing. For this purpose, the ground milling machines can lower the milling drum into the ground and remove ground layers at a desired milling depth. Even if these machines are generally reliable in use, operating situations may occur in which the primary drive unit fails, for example due to engine damage. Since ground milling machines are often used in construction site situations that are subject to high deadline pressure, it is important in such cases to be able to move the ground milling machine out of the specific construction site position as quickly as possible so that, for example, milling works can be continued by another ground milling machine. Ground milling machines, especially of the center rotor type, in which the ground milling device is arranged between front and rear travel units, such as wheels and/or crawler tracks, as seen in the direction of travel of the machine, are very heavy machines and usually cannot be moved without increased effort in the event of a defective primary drive unit. DE102012022732A1 suggests as a possible solution that the ground milling machine can be brought into a towable state with the aid of an auxiliary drive. This approach is already helpful, however, towing ground milling machines is also time consuming and often requires specialized towing vehicles.

Against this background, one aspect of the present invention is to provide a better way to move and relocate a ground milling machine in the case of a defective primary drive unit.

SUMMARY OF THE INVENTION

Thus, a generic self-propelled ground milling machine comprises a machine frame that constitutes the essential support structure of the ground milling machine. Further, an operator platform is provided from which the ground milling machine is operated in transport and milling operation. The drive energy required for regular operation of the ground milling machine is generated by a primary drive unit of the ground milling machine. In particular, said unit may be a diesel internal combustion engine. Another part of the ground milling machine is a ground milling device with a milling drum arranged inside a milling drum box and rotatable about a rotation axis. Finally, front and rear travel units are provided, wherein at least one of the front and/or rear travel units may be connected to the machine frame via a vertically adjustable lifting device. In particular, it is also possible for all of the travel units to be connected to the machine frame via a respective lifting device.

Driven units are often driven hydraulically. For a generic ground milling machine, it is provided in this context that at least one hydraulic drive circuit is provided for driving at least one of the travel units and/or for driving a milled material conveyor device. The drive circuit may comprise at least one main hydraulic pump driven by the primary drive unit and at least one hydraulic motor driven by the main hydraulic pump in a closed hydraulic circuit. The at least one hydraulic motor is thus, in particular, a travel drive hydraulic motor or a conveyor drive motor. In such a closed hydraulic circuit, the main hydraulic pump is thus supplied in a closed circulation system with the hydraulic fluid returning from the respective hydraulic motor. In a closed hydraulic circuit of this type, pressurized hydraulic fluid is thus present in the line system on both the high-pressure side and the low-pressure side. A closed hydraulic circuit of this type may further have additional elements consuming torque and/or hydraulic fluid volume, such as a feed pump to compensate for leakage oil losses, a purging branch, etc. Also, multiple hydraulic motors, in particular connected in parallel, may be driven by a closed hydraulic circuit. In generic ground milling machines, this may be the case, for example, with the travel motors of the travel units.

According to the present invention, the at least one hydraulic drive circuit has a separation and/or connection point in the conveying direction upstream and downstream of the at least one hydraulic motor, in particular in each case. A separation and/or connection point thus designates a device within the hydraulic fluid routing of the closed hydraulic circuit with which the closed hydraulic circuit can be separated with regard to its hydraulic fluid routing (separation point). This separation point, or another point, can now be used to connect an emergency hydraulic supply system, as described below. The separation and/or connection point thus refers to a device that is already set up such that it is configured for, at least functionally, separating the existing hydraulic lines and for connecting other hydraulic lines. This may also include a physical separation of one or more lines of the closed hydraulic circuit and/or a purely functional separation, for example, via one or more, in particular pre-installed, valves. Combinations are also possible. The configuration as a separation and/or connection point means that the connection of another hydraulic fluid connection is possible at the separation point toward the hydraulic motor. The closed hydraulic circuit thus comprises designated separation and/or access points for connecting an emergency hydraulic pump. The emergency hydraulic pump is part of an emergency hydraulic supply system, ideally essentially permanently installed in the ground milling machine. The emergency supply system can be connected to the separation and connecting points for emergency operation of the at least one hydraulic motor such that the closed hydraulic circuit is interrupted and hydraulic fluid can be conveyed by the emergency hydraulic pump in an open emergency hydraulic circuit to drive the at least one hydraulic motor while bypassing the main hydraulic pump. This makes it possible to drive the hydraulic pump at least for a limited period of time, although with low power, but sufficiently for belt emptying and/or for a travel movement of the ground milling machine. The essential step here is, on the one hand, to open the closed hydraulic circuit, so to speak, which is intended for regular operation, and thus make it accessible for operation by the emergency hydraulic pump. On the other hand, bypassing the main hydraulic pump, which is thus eliminated as an additional load to be supplied, increases the efficiency of this emergency system. Virtually, the entire hydraulic power of the emergency hydraulic pump is available to drive the hydraulic motor previously integrated in the closed hydraulic circuit. This means that the emergency hydraulic pump can be configured to be small and compact and comparatively low in power, for example, compared with the main hydraulic pump.

There may be cases in which the conveyor belt and the travel drive are driven via separate closed hydraulic circuits, each comprising a main hydraulic pump and at least one hydraulic motor. In this case, both of the closed hydraulic circuits may have respective separation and connection points of the type described above. However, in this case, in particular, only one single emergency hydraulic pump may be provided on the ground milling machine, so that usually a connection is first made to the closed hydraulic circuit of the conveyor belt for emptying the conveyor belt load, and thereafter the connection of the emergency hydraulic pump is changed toward the closed hydraulic circuit of the travel drive for moving the ground milling machine. This can be done manually, for example, by reconnecting hoses and/or via suitable valves.

With regard to the specific positioning of the separation and connection points in the closed hydraulic circuit, there are various possible variations. In principle, it is advantageous if the separation and connection points are positioned in the conveying direction of the closed hydraulic circuit in such a way that conveying distances are as short as possible. Independently of this, it is advantageous if, when connecting the emergency supply system, a feed pump and/or a purge stage of the closed hydraulic circuit are bypassed by the open emergency hydraulic circuit. It is ideal if, when connecting the emergency supply system, in particular all elements of the closed hydraulic circuit consuming torque and/or hydraulic fluid are bypassed except for the at least one respective hydraulic motor. This ensures that the largest possible proportion of the hydraulic energy generated by the emergency hydraulic pump can be used to drive the respective hydraulic motor. It is preferred if the separation and/or connection point can be reached and/or operated from the operator platform.

In terms of structure, various embodiments of the separation and connection points are encompassed by the present invention as well. In particular, the separation and connection points may have switching valves, especially 3/2- or 4/3-way valves, in particular comprising a blocking position and one or two conveying positions. Such switching valves may also be supplemented with couplings, especially quick couplings, to facilitate separation of the closed hydraulic circuit and connection of the emergency hydraulic pump and a tank discharge line. Additionally or alternatively, the piping system of the emergency supply system may be wholly or partially pre-installed on the ground milling machine, for example, in the form of pre-installed piping and/or hosing, and/or is established in an emergency, such as by the use of flexible hoses, etc. Similarly, suitable switching means, for example, for use as a separation and/or connection point, may also be pre-installed or only established when required.

The essential task of the emergency hydraulic circuit is to provide at least sufficient drive energy in an emergency to enable powered belt emptying and/or at least slow travel drive of the ground milling machine so that it can move to another location and/or onto a transport vehicle in a self-propelled manner. For this purpose, the emergency hydraulic circuit may have a hydraulic pump, in particular a controllable hydraulic pump, as an emergency hydraulic pump. Said hydraulic pump may be permanently installed on the ground milling machine. In order to be able to control, for example, supply and/or return and/or a blocking position, a switching valve, in particular a manually operable switching valve, especially a 4/3-way valve, may be provided. For practical operation, it has proven useful to have a control element of the emergency hydraulic circuit located or arrangeable on the operator platform of the ground milling machine.

The drive energy required to drive the emergency hydraulic pump may be provided by the primary drive unit or by an auxiliary drive unit independent of the primary drive unit. The auxiliary drive unit may, for example, include an internal combustion engine and/or an electric motor. The auxiliary drive unit is arranged in the engine compartment of the ground milling machine. The emergency hydraulic pump may be a separate, dedicated emergency hydraulic pump. However, it is also possible that an already existing hydraulic pump, which is operated in an open hydraulic circuit during regular operation of the ground milling machine, is turned into an emergency hydraulic pump in an emergency by suitable modification of the connection paths, in particular, as described above and also below.

The extent to which components of the emergency supply system are permanently pre-installed on the ground milling machine may vary. In extreme cases, the changeover to drive the at least one hydraulic motor by the emergency supply system may be carried out entirely manually. On the other hand, it is also possible that the entire emergency supply system is permanently installed in the ground milling machine. It is also conceivable that a machine controller automatically detects the emergency supply mode or that such a mode is manually specified by an operator. To control the emergency supply system, control elements may be used that are also used to operate the ground milling machine during regular operation. This has the advantage that no additional control elements need to be installed. Separate control elements are possible, however. One or more safety circuits may also be provided, for example, to protect one or more hydraulic pumps, etc. It has proven useful if the ground milling machine has at least partially permanently installed pipelines and/or hydraulic hoses of the emergency supply system to enable reliable and, in particular, also facilitated changeover in an emergency. For the approach to the separation and connection points, it is advantageous if the emergency supply system has flexible hose sections, in particular, comprising connecting elements that can be connected to the separation and connection points. Conversely, it is also preferred if the emergency supply system does not have a structurally fixed connection to the closed hydraulic circuit during regular operation. This serves, in particular, to ensure operational safety, for example, to prevent an unintentional fluid connection between components of the emergency supply system and the closed hydraulic circuit, which is under comparatively high pressure.

It is advantageous if the emergency hydraulic pump is driven completely independently of the primary drive unit, in particular, by means of an auxiliary drive unit which is by at least a factor of 5, in particular by at least a factor of 10, less powerful than the primary drive unit.

It is known that ground milling machines have an auxiliary motor, for example, in order to be able to rotate a milling drum independently of a significantly more powerful primary drive unit during maintenance works. According to the present invention, such an auxiliary motor for generating drive energy independently of the primary drive unit may now also be used as a supplement or alternative to generate compressed air for a chisel hammer, to drive a pump for filling a water tank of the ground milling machine or to perform other drive functions. Ideally, this auxiliary motor is also configured to drive the emergency hydraulic pump and thus performs at least a dual function. It is then possible to operate the emergency supply system without having to generate the drive energy required for this using the primary drive unit.

The separation and/or connection point is selected such that a reversal of the conveying direction and thus a reverse operation of the at least one hydraulic motor by the emergency supply system is also possible.

It is possible that, in addition to driving the milled material conveyor and/or one or more travel units, further functionalities are included in the present drive concept for emergency operation of a ground milling machine. These may include, for example, driving steering devices, pivoting devices, roof adjustments, etc. In principle, all hydraulic motors may be taken into account here in a corresponding manner.

The ground milling machine is particularly suitable for carrying out the method according to the present invention described below.

Another aspect of the present invention relates to a method for operating a ground milling machine, in particular a ground milling machine according to any one of the claims, in an emergency mode. Essential steps include separating a closed hydraulic circuit, comprising a main hydraulic pump and a hydraulic motor and provided in regular operation for driving at least one travel unit and/or at least one milled material conveyor, at at least one separation and connection point; establishing, in particular subsequently, a connection to an emergency hydraulic pump via the at least one separation and connection point; and, finally, conveying, by the emergency hydraulic pump, hydraulic fluid to the hydraulic motor while bypassing at least the main hydraulic pump, in particular while bypassing all other torque- and/or hydraulic fluid-consuming elements of the (previous) closed hydraulic circuit. Since there is no longer a closed hydraulic circuit system in the emergency mode, it is further advantageous that the other of the two separation and connection points is used to establish a discharge line to a hydraulic tank. This allows the fluid conveyed to the hydraulic motor by the emergency hydraulic pump to be returned to the hydraulic tank essentially without pressure. More than one separation and/or connection point may be provided, in particular at least two.

Generally, it is preferred in one embodiment to use an already existing tank system that is used for regular operation, both with regard to the hydraulic fluid supply to the emergency hydraulic pump and with regard to the return of the hydraulic fluid from the hydraulic motor to the tank.

The emergency hydraulic pump may be driven by an auxiliary drive unit that can be operated completely independently of the primary drive unit. Even in the event of a total failure of the primary drive unit, emergency operation is still possible in this manner, which allows, for example, at least slow travel and/or slow unloading of the conveyor.

BRIEF DESCRIPTION OF THE DRAWINGS

The present invention will be described in more detail below by reference to the embodiment examples shown in the figures; In the schematic figures.

Like components are designated by like reference numerals in the figures, although not each recurring component is necessarily designated separately in each figure.

DETAILED DESCRIPTION OF THE INVENTION

Figure 1:
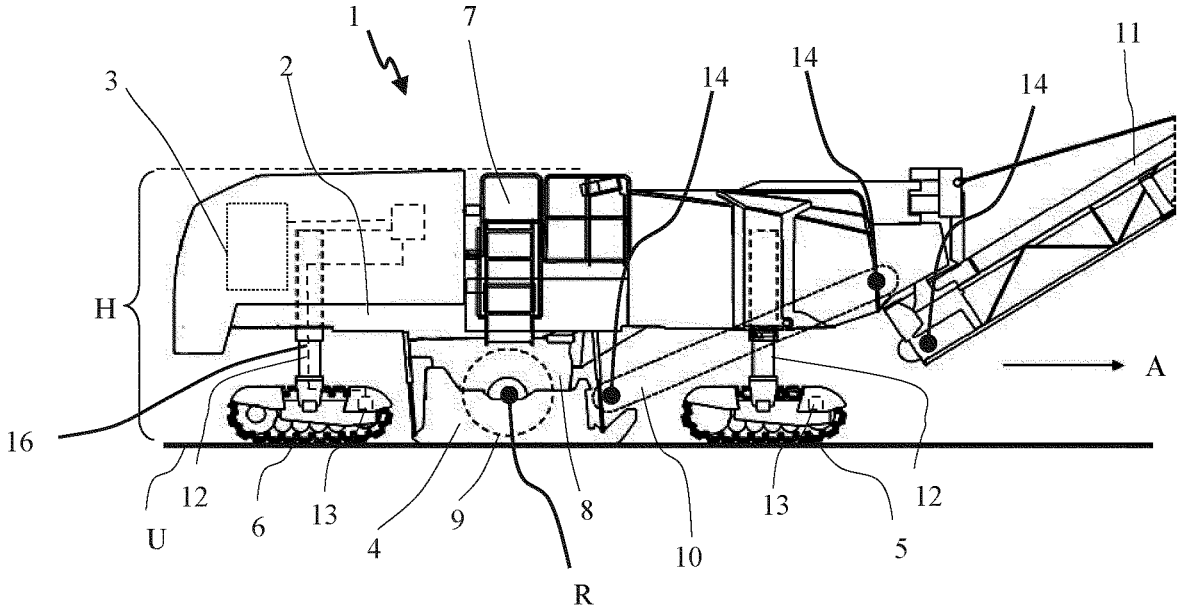
FIG. 1 is a side view of a center rotor type ground milling machine.
Figure 2:
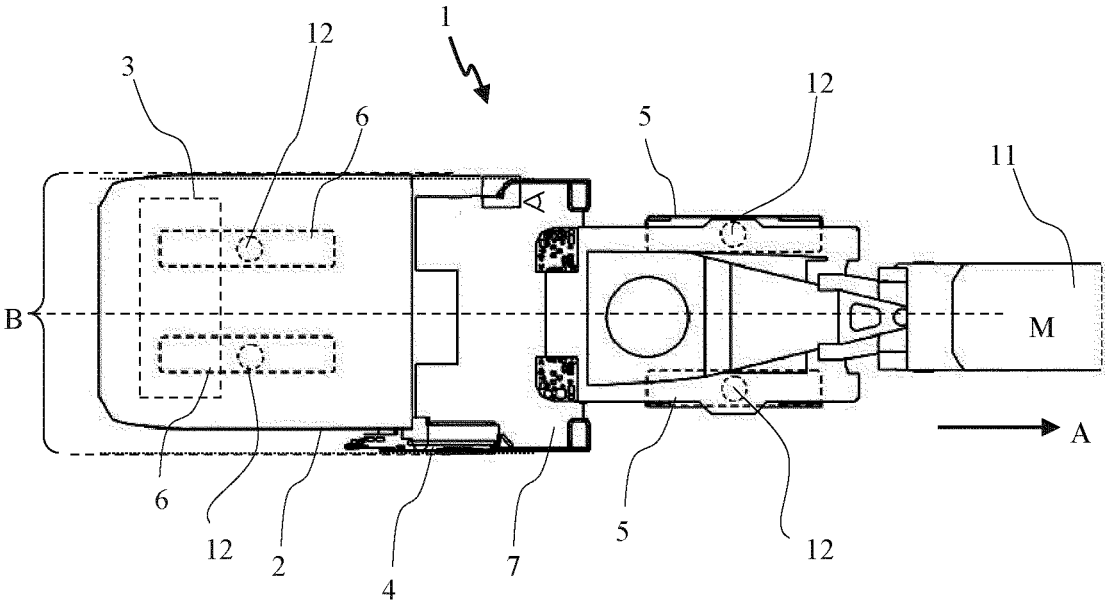
FIG. 2 is a top view of the ground milling machine of FIG. 1.

FIG. 1 shows a side view of a ground milling machine 1, more specifically the right side of the machine relative to the forward direction A. The essential elements of the ground milling machine 1 are a machine frame 2, a primary drive unit 3, preferably a diesel internal combustion engine, a ground milling device 4, front travel units 5, rear travel units 6 and an operator platform 7. The ground milling device comprises a milling drum box 8, inside which a milling drum 9 (indicated by dashed lines in FIG. 1) is provided. The latter may comprise a hollow-cylindrical support tube with a plurality of milling tools arranged on its outer circumferential surface. The milling drum 9 rotates about a horizontal rotation axis R extending transversely to the forward direction A. In milling operation, the milling drum 9 engages the ground U and mills off ground material. The resulting milled material is collected in the milling drum box 8 and can then be loaded via transport devices 10 and 11, for example, onto a transport vehicle. The transport device 10 may be an internal conveyor belt, whereas the transport device 11 may be a so-called external or attached conveyor belt. The embodiment example shown in the figures shows a ground milling machine 1 in which the ground milling device 4 is arranged between the front travel devices 5 and the rear travel devices 6, as seen in the forward direction A. However, the present invention also encompasses ground milling machines in which the ground milling device 4 is arranged at the level of the rear travel units, as seen in the forward direction A, as is the case with so-called rear rotor type milling machines. These ground milling machines are used, for example, for asphalt milling or for milling asphalt covers in need of rehabilitation. During milling operation, the ground milling machine 1 usually moves in forward direction A, so that this direction can also be referred to as the working direction. The ground milling machine is thus, in particular, a road cold milling machine.

The travel devices 5 and/or 6 may be connected to the machine frame 2 via lifting devices, such as, for example, lifting columns 12 in this case. By adjusting the height of the lifting columns 12, the vertical distance of the machine frame and thus, for example, the depth of immersion of the milling drum 9 into the ground U may be varied. In the present case, all of the front and rear travel devices 5/6 are each connected to the machine frame 2 via such a lifting column 12. Embodiments in which only the front or only the rear travel devices are connected to the machine frame via corresponding lifting columns are also possible.

The drive energy required to operate the ground milling machine 1 is provided by the primary drive unit 3. The latter may be arranged in the rear of the machine, as shown, for example, in FIG. 1. Further, a hydraulic drive system is provided. Individual hydraulic consumers of the ground milling machine 1 may be arranged in one or more closed hydraulic circuits. Such a hydraulic consumer may be hydraulic motors, for example hydraulic motors 13 for travel drive and/or hydraulic motors 14 for driving the transport devices 10 and 11. As an example of the hydraulic motor 13 for driving the travel unit 6 located on the rear right-hand side of the ground milling machine 1, a main hydraulic pump 15 driven directly or indirectly by the primary drive unit 3 is provided in FIG. 1, which is arranged in a closed hydraulic circuit 16 with the hydraulic motor 13, shown only indicated in FIG. 1. The same can be the case for the other hydraulic motors 13 and/or 14. It is also possible that multiple closed hydraulic circuits are provided, for example a closed hydraulic circuit for two or more hydraulic motors 13 of the travel units 5 or 6, and another closed hydraulic circuit separate therefrom for driving the hydraulic motor or motors 14. Each closed hydraulic circuit has its own main hydraulic pump 15.

Figure 3:
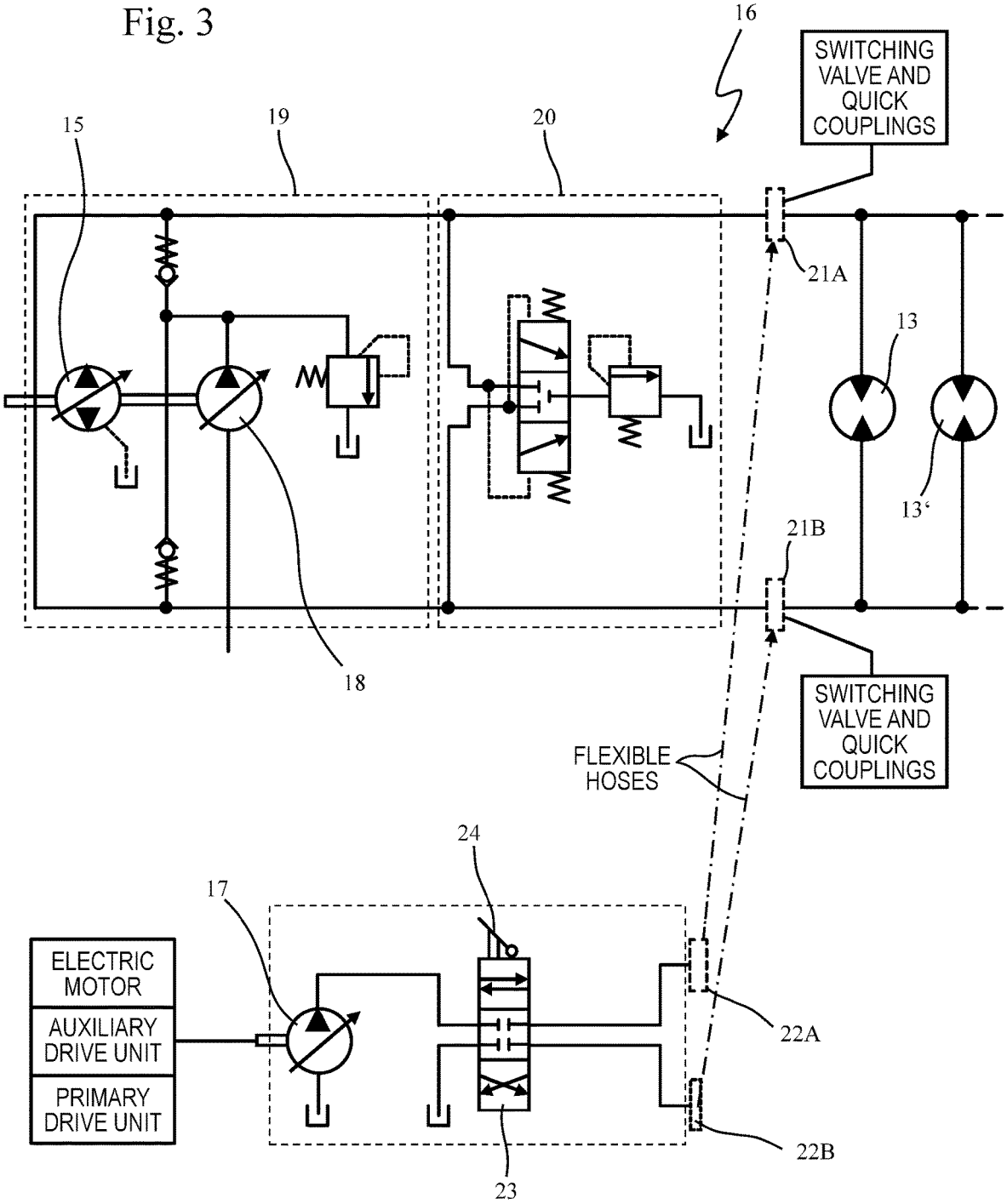
FIG. 3 is a hydraulic circuit diagram.

FIG. 3 illustrates further details of the closed hydraulic circuit 16 and the auxiliary connection of an emergency hydraulic pump 17 according to the present invention. The main components of the hydraulic circuit 16 are the main hydraulic pump 15 and the hydraulic motor 13 connected to the closed hydraulic circuit via the line system. In FIG. 3, the hydraulic motor 13' further indicates the option of connecting multiple hydraulic motors, in parallel with each other, in a common closed hydraulic circuit 16. This may be the case, in particular, for the hydraulic motors of the travel units 5 and 6. The closed hydraulic circuit 16 according to FIG. 3 may further comprise a feed pump 18 which is configured to compensate, for example, for leakage oil losses and/or for fluid quantities branched off from the closed hydraulic circuit for cooling and/or filtering purposes. These components may be structurally combined in a pump module 19. Furthermore, a purging device may be provided, which may also be configured as a modular component 20.

Two separation and connection points 21A and 21B are now provided in the closed hydraulic circuit 16, in particular external to the two modules 19 and 20 in the line system of the hydraulic circuit 16. Via the separation and connection points 21A and 21B, the line system of the closed hydraulic circuit 16 can be opened and connected to the emergency hydraulic pump 17. The emergency hydraulic pump 17, or the corresponding emergency supply system, comprises two connection points 22A and 22B, to provide fluid communication in both directions of flow of the hydraulic motor 13. In the present case, this enables the ground milling machine 1 to move forward and backward in a self-propelled manner even in the emergency mode, which can facilitate maneuvering.

FIG. 3 illustrates that the separation and connection points 21A and 21B are arranged in the closed hydraulic circuit 16 in such a way that the main hydraulic pump 15, the feed pump 18 and the purge stage 20 are not supplied with hydraulic fluid when the emergency hydraulic pump 17 is connected and, accordingly, are bypassed by the open hydraulic circuit toward the hydraulic motor 13 obtained by connecting the emergency hydraulic pump 17.

The obtained emergency hydraulic circuit may have a valve device 23 arranged between the emergency hydraulic pump and the hydraulic motor 13, in particular manually operable via an actuating lever 24. Connection to a control unit of the ground milling machine is also possible here. With the aid of the valve device 23, the conveying direction toward the hydraulic motor 13 can be reversed. A blocking position of the valve device 23, which prevents any fluid conveyance in the open hydraulic circuit, may also be provided.

The emergency hydraulic pump 17 may be driven by an electric motor, an auxiliary motor and/or by the primary drive unit.

Figure 4:
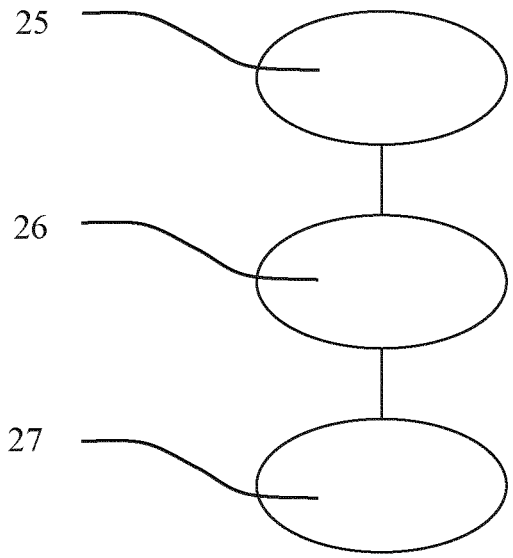
FIG. 4 is a flow chart of a method according to the present invention.

Finally, FIG. 4 illustrates the sequence of a method according to the present invention for operating a ground milling machine 1 in an emergency mode of operation. Step 25 includes, for example after the primary drive unit has failed, separating, at two separation and connection points, a closed hydraulic circuit having a main hydraulic pump and a hydraulic motor and provided in regular operation for driving at least one travel unit and/or at least one milled material conveyor, for example, as shown in FIG. 3. Thereafter, step 26 includes establishing a connection to an emergency hydraulic pump via at least one of the two separation and connection points. Once this has been done, step 27 includes conveying, by the emergency hydraulic pump, hydraulic fluid to the hydraulic motor while bypassing at least the main hydraulic pump, in particular while bypassing all torque- and/or hydraulic fluid-consuming elements.

While various aspects in accordance with the principles of the invention have been illustrated by the description of various embodiments, and while the embodiments have been described in considerable detail, they are not intended to restrict or in any way limit the scope of the invention to such detail. The various features shown and described herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A self-propelled ground milling machine, comprising:

a machine frame, an operator platform, a primary drive unit, a ground milling device with a milling drum arranged within a milling drum box and rotatable about a rotation axis (R), front and rear travel units, wherein at least one of the front and/or rear travel units is connected to the machine frame via a vertically adjustable lifting device, wherein at least one hydraulic drive circuit is provided for driving at least one of the travel units and/or for driving a milled material conveyor, with at least one main hydraulic pump driven by the primary drive unit and at least one hydraulic motor driven by the main hydraulic pump in a closed hydraulic circuit, wherein the at least one hydraulic drive circuit has a separation and/or connection point upstream and downstream of the at least one hydraulic motor; and the ground milling machine has an emergency hydraulic pump which is part of a hydraulic emergency supply system, wherein the emergency supply system is connected to the separation and/or connection points for emergency operation of the hydraulic motor such that hydraulic fluid can be conveyed by the emergency hydraulic pump in an open emergency hydraulic circuit to drive the at least one hydraulic motor while bypassing the main hydraulic pump, wherein drive energy required to drive the emergency hydraulic pump is provided by an auxiliary drive unit independent of the primary drive unit and the auxiliary drive unit includes an electric motor, wherein the emergency hydraulic pump is operated in an open hydraulic circuit during regular operation of the ground milling machine and used in an emergency via the connection to the separation and/or connection points, and wherein the separation and/or connection points are selected such that a reversal of a conveying direction, and thus a reverse operation of the at least one hydraulic motor by the emergency supply system, is possible.

2. The self-propelled ground milling machine according to claim 1, wherein the separation and connection points in the closed hydraulic circuit are positioned such that:

when connecting the emergency supply system, a feed pump and/or a purge stage of the closed hydraulic circuit are bypassed by the open emergency hydraulic circuit; and when connecting the emergency supply system, all torque- and/or hydraulic fluid-consuming elements of the closed hydraulic circuit are bypassed except for the at least one hydraulic motor.

3. The self-propelled ground milling machine according to claim 1, wherein the separation and/or connection points include at least one of the following features:

the separation and/or connection points comprise switching valves comprising a blocking position and one or two conveying positions; and the separation and/or connection points comprise quick couplings.

4. The self-propelled ground milling machine according to claim 1, wherein the emergency hydraulic circuit includes at least one of the following features:

the emergency hydraulic circuit comprises a hydraulic pump permanently installed on the ground milling machine;

the emergency hydraulic circuit comprises a switching valve;

the emergency hydraulic circuit comprises a 4/3-way valve; and the emergency hydraulic circuit comprises a control element arranged or arrangeable on the operator platform of the ground milling machine.

5. The self-propelled ground milling machine according to claim 1, wherein the emergency supply system includes at least one of the following features:

the emergency supply system comprises pipelines and/or hydraulic hoses permanently installed in the ground milling machine;

the emergency supply system comprises flexible hose sections for approaching the separation and/or connection points, comprising connecting elements that can be connected to the separation and/or connection points.

6. The self-propelled ground milling machine according to claim 1, wherein the emergency hydraulic pump is driven completely independently of the primary drive unit via an auxiliary drive unit which is by at least a factor of 5, less powerful than the primary drive unit.

7. A method for operating the ground milling machine according to claim 1, in an emergency mode of operation, comprising the steps of:

separating, at the separation and/or connection points, the closed hydraulic circuit having the main hydraulic pump and the hydraulic motor provided in regular operation for driving at least one of the travel units and/or at least one milled material conveyor;

establishing a connection to the emergency hydraulic pump via the separation and/or connection points; and conveying, by the emergency hydraulic pump, hydraulic fluid to the hydraulic motor while bypassing at least the main hydraulic pump.

8. The method according to claim 7, wherein the method further includes establishing a discharge line to a hydraulic tank.

* * * * *